United States Patent [19]

Van Blankenburg

[11] Patent Number: 4,522,443

[45] Date of Patent: Jun. 11, 1985

[54] PICNIC TABLE

[76] Inventor: Karl Van Blankenburg, 32131 Claeys Dr., Warren, Mich. 48093

[21] Appl. No.: 521,995

[22] Filed: Aug. 11, 1983

[51] Int. Cl.[3] ..... A47B 39/00

[52] U.S. Cl. ..... 297/157; 108/153

[58] Field of Search ..... 297/157, DIG. 2; 108/153; 211/134; D6/337, 487, 479

[56] References Cited

U.S. PATENT DOCUMENTS

| | | | |
|---|---|---|---|
| D. 165,777 | 1/1952 | Offutt et al. | 297/157 X |
| 2,805,708 | 9/1957 | Bohn | 297/157 |
| 2,964,368 | 12/1960 | Hever | 297/157 |
| 3,134,625 | 5/1964 | Bliss | 297/157 |
| 3,406,786 | 10/1968 | Lang | 108/153 X |
| 3,664,513 | 5/1972 | Atwater | 211/134 |
| 4,002,369 | 1/1977 | Jennings | 297/DIG. 2 |

*Primary Examiner*—James T. McCall

*Attorney, Agent, or Firm*—Barnes, Kisselle, Raisch, Choate, Whittemore & Hulbert

[57] ABSTRACT

A table for picnics or other uses which is constructed of four identical J-shaped weatherpoof parts, two of which can be assembled back-to-back for each end support. Ordinary planks form bridging parts for the end structures to provide the top and bench portions of the table. Angle braces provide stability to the assembly.

2 Claims, 4 Drawing Figures

PICNIC TABLE

FIELD OF INVENTION

Furniture such as a picnic table assembleable from components.

BACKGROUND OF INVENTION

Picnic tables which are subject to weather, sometimes all the year around, tend to disintegrate from rotting since they have legs in contact with the ground and subject to moisture and insects. In addition, in the manufacture of these tables, they are frequently made from wood and when assembled are very cumbersome and thus difficult to ship.

The present invention relates to a picnic table construction which consists essentially of four basic and identical weatherproof parts. These parts are easily packed for shipment and readily assembled into a table and side benches by the addition of five two-by-ten planks which can be purchased at any local lumber yard.

The essential parts are formed of a molded foam plastic which is relatively light but impervious to water so they can rest on the ground and not be subject to destruction by varying weather conditions.

Other objects and features of the invention will be apparent in the following description and claims in which the invention is described together with details which will enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
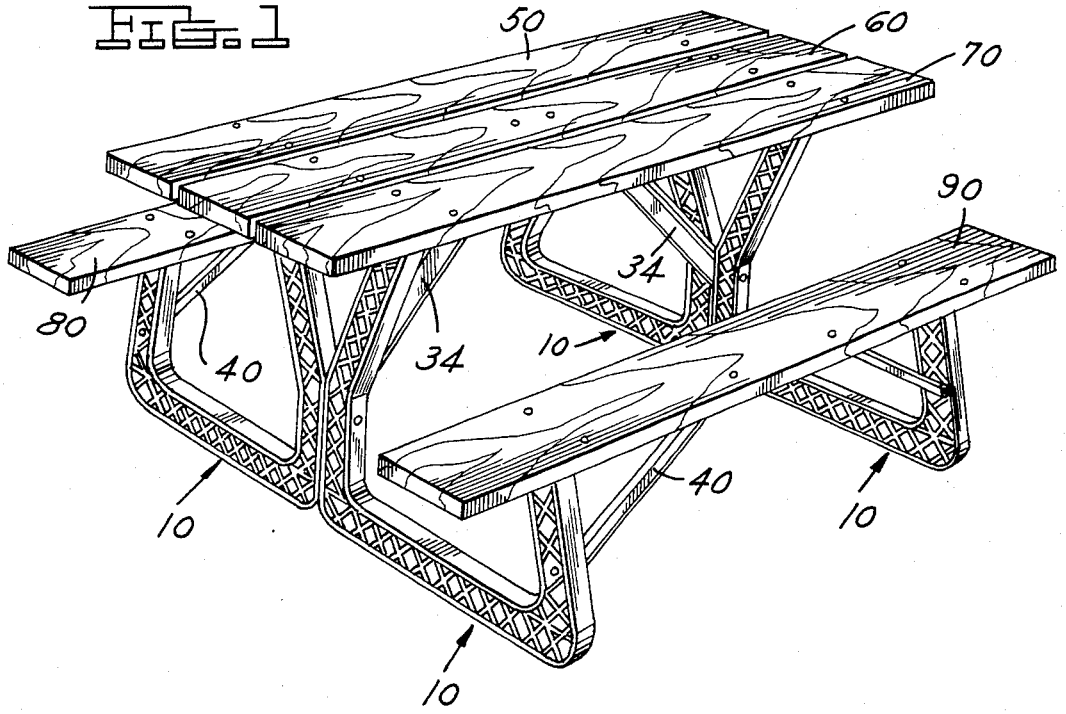
FIG. 1, a perspective view of a completed table.
Figure 2:
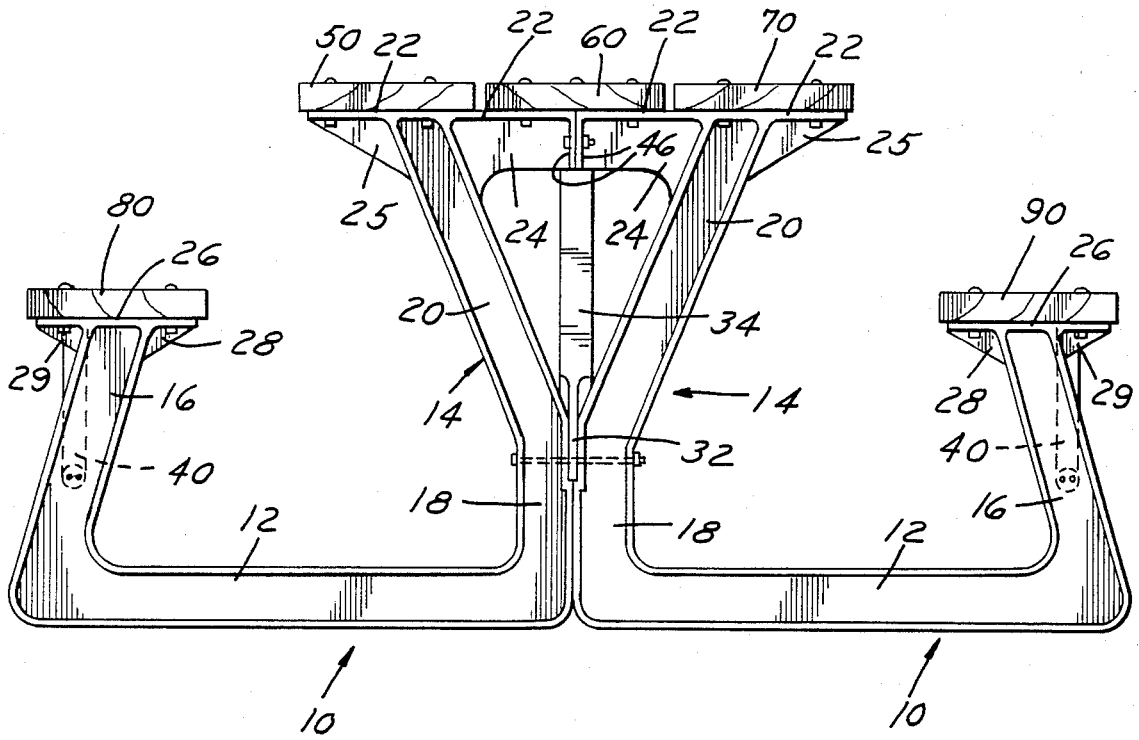
FIG. 2, an end view of an assembled table.
Figure 3:
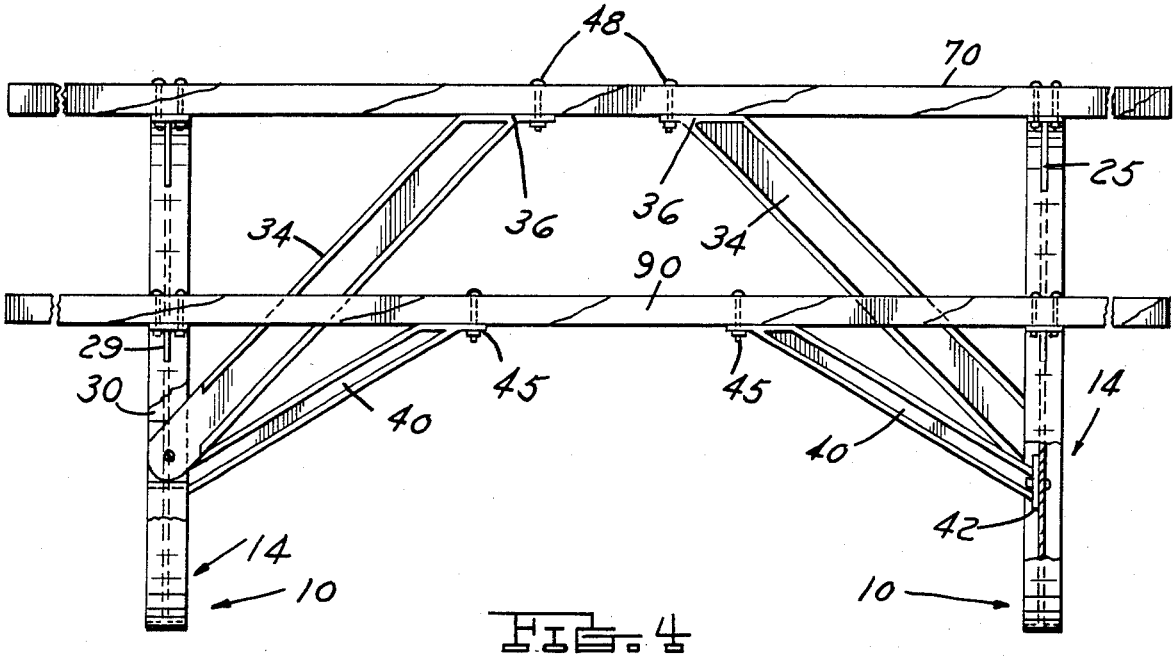
FIG. 3, a side view of the assembled table.
Figure 4:
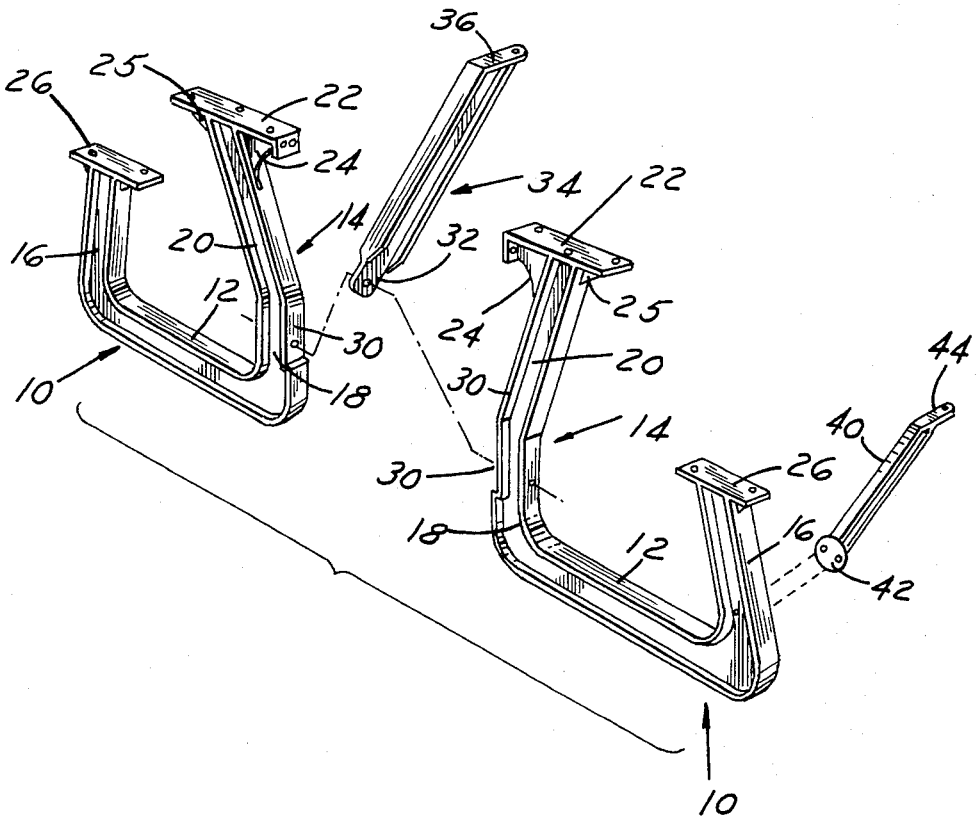
FIG. 4, an exploded view showing the basic parts of one end prior to assembly.

Four J-shaped identical parts 10 are the basic elements for the table construction. The shape of these parts is best illustrated in FIGS. 2 and 4. Each part 10 has a base run 12, a back upright 14, and a front upright 16. These parts are formed integrally as a molded plastic preferably with an I-section to add strength, reduce material and add to the attractiveness of the elements. The back upright portion 14 has a short section 18 which is perpendicular to the base run 12 and a second section 20 which angles toward the front upright 16. At the top of the section 20 is a horizontal fastening support pad 22 braced by molded gussets 24 and 25 and provided with holes for assembly of top planks.

The front upright 16 angles inwardly at a slight angle toward the back upright and has at the top end a horizontal fastening pad 26 with bracing gussets 28, 29.

As best illustrated in FIGS. 2 and 4, the back uprights have a slight offset 30 terminating in a horizontal shoulder which provides, when the parts are placed back to back, a recess to receive a flange end 32 of an angle brace 34. This brace has a flat top pad 36 to have flat contact with a table plank.

A second angle brace 40 is provided to fasten at its lower end 42 to the front upright 16 and at its upper end 44 to a seat plank.

In assembling the table, it is first necessary to obtain five planks, three for the top and two for the respective side benches. Planks 2"×10" are preferred and the length is optional. The planks can, for example, be 6, 7 or 8 feet long. Planks of pine, or fir are acceptable and can be treated for weatherproofing or painted as desired.

The base back uprights 18 are drilled to receive a bolt which can also transfix the flange 32 of brace 34. Suitable nuts and washers unite the two end sections 10 and in this position, the upper portions 20 diverge but the pads 22 form a substantially continuous support area. These may be inverted on to the three top planks and holes drilled to register with the holes in support pads 22 and the top end 36 of angle brace 34. As shown in FIG. 2, the top planks 50, 60 and 70 are spaced so that the middle plank 60 bridges the inner ends of the pads 22. A depending flange 46 on the inner end of pad 22 mates with and is bolted on each side to a similar flange on the opposing section as shown in FIG. 2. The outer planks 50 and 70 are bolted to the outer ends of pads 22.

Thus, the end sections 10 are secured firmly to each other at the sections 18 and the flanges 46 and further secured by the bridging center plank 60. The top pad 36 of the angle brace 34 is also bolted to center plank 60 at 48.

With the top planks fully bolted to the joined end sections, the bench planks 80 and 90 can be bolted to the top pads 26 of the outer uprights 16. Angle braces 40 are secured at 42 to the uprights 16 and at the upper ends 44 to bench planks at 45. With all bolts and accompanying washers and nuts in place and secured, the assembly is complete and a sturdy unitary structure results. It will be appreciated that the top planks may be other than wood planks if substitute material is desired. For example, a plywood top may be used on even plastic elements.

The J-shaped sections 10 are molded with the I-beam section of a foamed plastic to provide a relatively light but strong bridge structure with moisture impervious surfaces which will resist weather deterioration. It will be appreciated that the four identical sections 10 can be packaged along with the angle pieces 38 and 40 in a single box and readily shipped economically.

I claim:

1. A table assembly which comprises:

(a) end supports comprising back-to-back identical leg units each having back uprights joined together to support one or more bridging top elements, and shorter front uprights to support bridging bench elements, the back uprights being parallel to each other in a lower section and diverging from each other in an upper section, (b) a recess being formed on the contiguous areas of the lower sections to receive a flange of an angle support, and means transfixing the said lower sections and said flange, the other end of said angle support being fastened to the bottom of a bridging table element.

2. In a table assembly which includes two pairs of support elements, one pair at each end of the table, each pair being formed of identical back-to-back leg units joined together at a central plane to support one or more bridging top elements, and shorter front bench uprights to support bridging bench elements, that improvement in which leg units in each pair are disposed in a common plane, each leg unit comprising a generally J-shaped integral element having a horizontal base run extending from said central plane to the outer dimension of the bench upright, a vertical back upright portion extending parallel to and adjacent said central plane for a portion of the vertical dimension of the leg unit, a supporting portion angling away from said vertical upright portion over said base run to an area adjacent the outer edges of a bridging unit forming the table, and a seat support portion extending from the outer end of said base run upwardly to a bench height and angled inwardly over said base run.

* * * * *